United States Patent [19]

Knippel et al.

[11] 4,224,875

[45] Sep. 30, 1980

[54] STATIC SWITCHING APPARATUS FOR PASSENGER VEHICLE

[75] Inventors: Willis H. Knippel; Thomas R. Schmitz, both of Palos Park, Ill.

[73] Assignee: Pullman Incorporated, Chicago, Ill.

[21] Appl. No.: 915,843

[22] Filed: Jun. 15, 1978

Related U.S. Application Data

[63] Continuation of Ser. No. 699,287, Jun. 24, 1976, abandoned.

[51] Int. Cl.[2] ..... E01B 7/00

[52] U.S. Cl. ..... 104/130; 246/427; 246/436; 246/458; 246/469

[58] Field of Search ..... 104/96, 104, 105, 130, 104/245, 247; 246/427, 436, 455, 457, 458, 468, 469

[56] References Cited

U.S. PATENT DOCUMENTS

| | | | |
|---|---|---|---|
| 3,017,503 | 1/1962 | Kniff | 246/458 X |
| 3,139,839 | 7/1964 | Ashworth | 104/130 |
| 3,593,668 | 7/1971 | Adams | 104/130 |
| 3,635,166 | 1/1972 | Peterson | 104/130 |
| 3,650,216 | 3/1972 | Harwick et al. | 104/130 X |
| 3,774,453 | 11/1973 | Welsh | 104/130 |
| 3,783,793 | 1/1974 | Perrott et al. | 104/245 X |
| 3,828,691 | 8/1974 | Purath | 104/130 X |
| 3,831,527 | 8/1974 | Peterson | 104/130 |

FOREIGN PATENT DOCUMENTS

| | | | |
|---|---|---|---|
| 1354888 | 5/1974 | United Kingdom | 104/130 |

*Primary Examiner*—Randolph A. Reese

*Attorney, Agent, or Firm*—Richard J. Myers; Stephen D. Geimer; Paul A. Kerstein

[57] ABSTRACT

A static switching apparatus for a track vehicle includes a main line track and a switch track which at a switching junction both include a conventional track rail and a specially constructed rail. A switching cam including cam faces is positioned at the junction and includes straight and curved cam surfaces which are selectively engaged by cam followers supported on the vehicle to provide for steering of the vehicle. The cam followers are lowered and raised vertically by fluid extensible devices which also move them in an orbital path into cam surface engagement.

5 Claims, 5 Drawing Figures

STATIC SWITCHING APPARATUS FOR PASSENGER VEHICLE

This is a continuation of Ser. No. 699,287, filed June 24, 1976, now abandoned.

BACKGROUND OF THE INVENTION

1. Field of the Invention

This invention pertains to railway vehicles and in particular to their supporting track structures and apparatus for switching the vehicle between different track sections.

2. Description of the Prior Art

A prior art disclosure is contained in U.S. Pat. No. 3,774,543 patented Nov. 27, 1973. The present invention is an improvement in that the switching arrangement includes at the switching junction conventional type track rails and specially built track rails. Raised flanges of the truck wheels on the vehicle are adapted to ride on the specially built track rails and the vehicle has in combination therewith an improved camming arrangement for steering the vehicle relative to the switching junction.

SUMMARY OF THE INVENTION

The present switching apparatus and vehicle includes a vehicle supporting track which provides guided movement for the vehicle and includes a main line track portion and a switch track portion which merges with the first track portion at a switching junction. The main line track portion at the switching portion includes a first continuous straight flange track rail of conventional design and a continuous substantially parallel flat track rail of a special design. The switch track portion at the switching junction also includes a continuous curved second flange track rail merging with the first flat track rail and a second curved flat track rail which merges with the first flanged track rail. A cam means as associated with the rails at their switching junction and a vehicle mounted steering cam follower is selectively movable into engagement with the cam means to steer or guide the vehicle from the main line track to the switching track or vice versa. During the switching and during certain operations of the main line track portion the flanged wheels of the vehicle are conventionally supported on the conventional track rail whereas the other wheels are provided with each flange in riding engagement on the top of a flat surface of the specially built track rail. Fluid extensible means provides for the followers supported on the vehicle to be moved in an orbital path into and out of engagement with the cam faces provided on a cam centrally positioned in the switching junction.

DESCRIPTION OF THE PREFERRED EMBODIMENT

Figure 2:
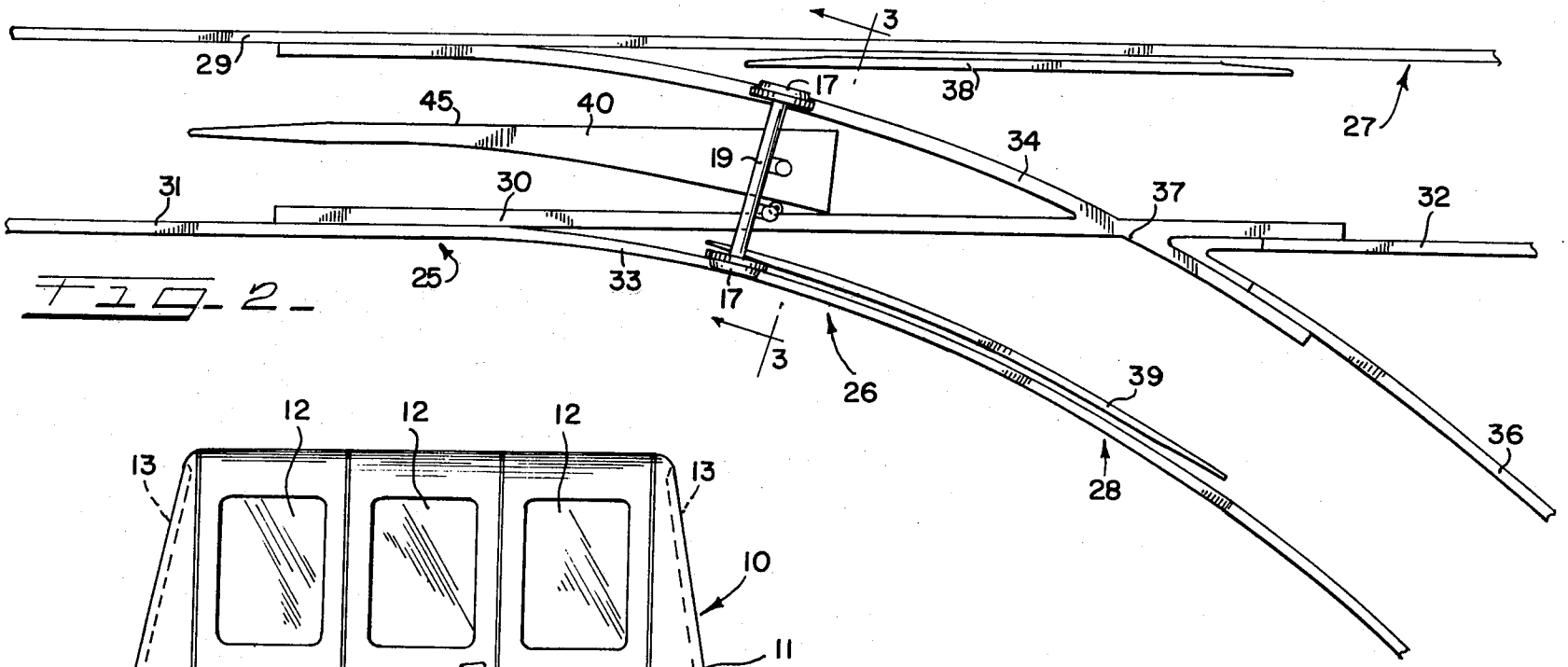
FIG. 2 is a top plan view of the stationary track structure involved with the present invention.
Figure 1:
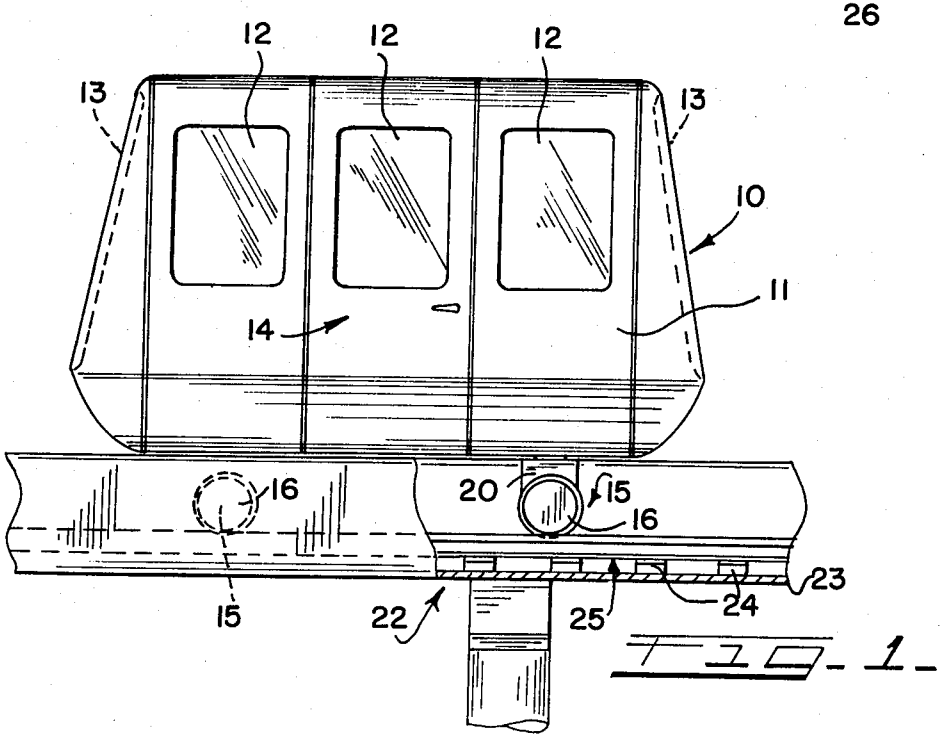
FIG. 1 is a side elevational view of a passenger vehicle supported on a track supporting structure.

A passenger vehicle of the tracked type is designated at 10 and includes a body 11. Suitable side windows 12 are provided in the body 11 and end windows 13 are provided at the opposite ends of the car. One of these side windows 12 is provided in a central door 14 providing for access to the interior of the vehicle 10. The body 11 is supported on wheel trucks 15 each of which includes a pair of conventional flanged wheels 16 having treads or rims 17 and a raised flange 18. The wheels are interconnected by axles 19 which project through a supporting and housing structure 20. The housing structure 20 supports the axle 19 and in turn is connected to a supporting structure 21 which suitably connects the structure 20 to the body 11. The vehicle 10 is shown supported on a track supporting structure 22 having a track bed 23 supporting longitudinally spaced track ties 24 which may be of conventional design.

Figure 3:
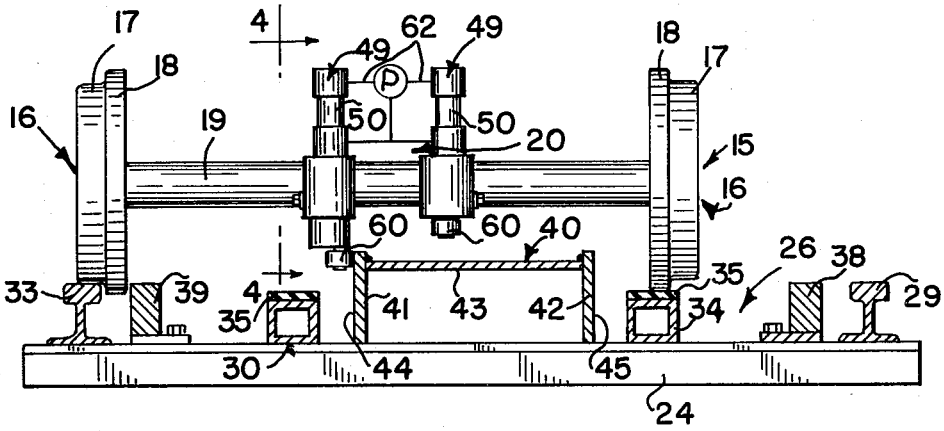
FIG. 3 is a cross-sectional view taken substantially along the line 3—3 of FIG. 2.

A rail track arrangement is designated at 25 and includes a switching junction generally designated at 26. The rail track further includes a main line track portion 27 and a switching portion 28 connected at the switching junction 26. The main line track portion 27 includes a first continuous flanged track rail 29 of conventional design and at the switching junction it also includes a substantially continuous flat track rail of special design designated at 30. Leading into the switching junction is a straight portion of flanged track rail 31 of conventional design. Similarly, a second straight portion of flanged track rail 32 is parallel to the straight rail 29 as it leaves the switching junction 26. The first straight portion of flanged track 31 also is integral with and meets a continuous curved flange track rail 33 forming part of the switching portion 28. A curved flat track rail of special design 34 meets at one end with a portion of the flat rail 29 and is then parallel in curving relation with respect to the rail 33. The specially built flat track rails 30 and 34 as best shown in FIG. 3 are constructed of a box-like section having secured thereon at the upper surface a flat hardened layer of tread which as best shown in FIG. 3 during switching is adapted to provide support for the raised flange 18 of one of the flanged wheels 16. A conventional rail track portion 36 is connected to the second curved flat track rail 34 which includes a juncture 37 at the meeting point of the rails 30, 32, 34 and 36. The main line track rail has positioned adjacent and parallel with respect thereto a straight guide rail 38 and similarly the curved track rail 33 is provided with a curved guide rail 39 adjacent and parallel with respect thereto.

As best shown in FIGS. 2 and 3, a cam 40 is positioned substantially centrally with respect to the rails 29 and 31, and includes a curved cam face 44 extending substantially parallel to portions of the rail 33 and a second cam surface 45 extending parallel to the rail 29. As best shown in FIG. 3, the cam surfaces 44 and 45 are provided on the outer portions of vertical walls 41 and 42 of the cam 40. The walls 41 and 42 are connected by means of a top wall 43.

Figure 4:
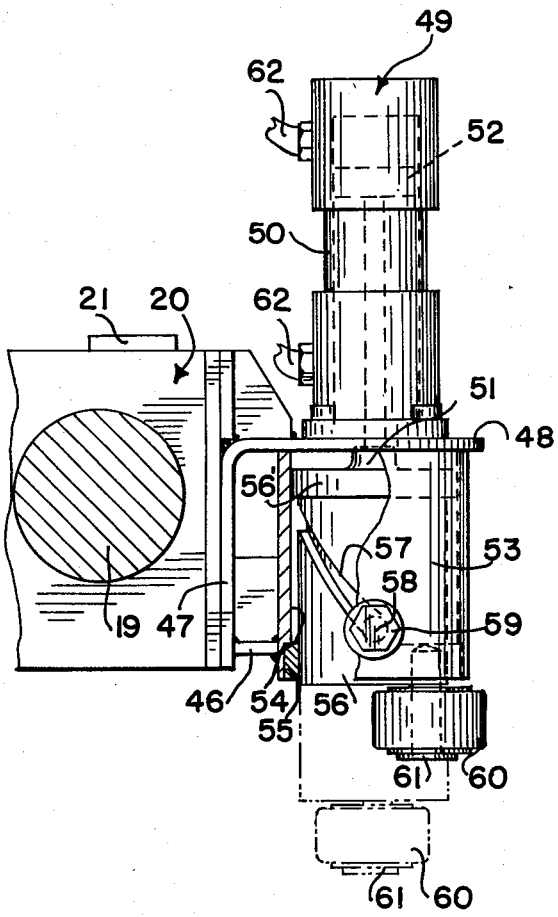
FIG. 4 is a cross-sectional view taken substantially along the line 4—4 of FIG. 3.

Referring now particularly to FIG. 4 a bracket structure 46 includes a vertical flange 47 which is rigidly connected to the housing 20 and a horizontal flange 48 which supports a pair of hydraulic extensible units generally designated at 49. The extensible units may be of conventional type adapted to be actuated by any type of fluid and each includes a cylinder 50 having a piston rod 51 connected to a piston 52 which moves vertically within the interior of the cylinder 50. As best shown in FIG. 3, suitable fluid line connections 62 are connected to a pump designated P which in turn may be connected to a suitable reservoir for directing fluid under pressure to opposite ends of the cylinder 50 in conventional fashion. A cylindrical housing 53 is provided with an inner cylindrical wall 54 and has at its lower end a cylindrical bearing 55. A cam cylinder 56 is connected at its upper end to a cylindrical bearing portion 56' which is guided within the inner cylindrical wall 54 for vertical movement. The cam cylinder 56 is provided with a spiral groove 57 which is engaged in mating relation with a guide pin 58 supported on the cylindrical housing 53 and extending inwardly with respect thereto. The guide pin 58 thus projects into the spiral groove 57 and is secured by means of a jam nut 59. Each of the cam cylinders 56 is provided at its lower end with a follower wheel 60 suitably supported and connected to the cam cylinder 56 by means of bearing and retainer pins 61 so that the follower wheels 60 may freely rotate about a vertical axis with respect to each of the cam cylinders 56.

THE OPERATION

Figure 5:
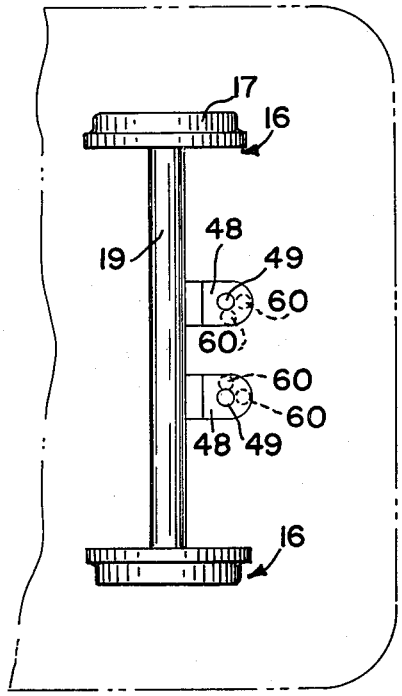
FIG. 5 is a schematic view in plan of a portion of a vehicle showing the orbital movement of cam followers supported thereon.

Assuming now that the passenger vehicle 10 is to be steered so that it passes through the switching junction and remains on the main track portion 27, the right hand fluid extensible unit 49 in FIG. 3 is actuated by proper selector mechanism (not disclosed) whereby the pump directs fluid into the right hand cylinder 50 forcing the piston 52 downwardly whereupon the cam cylinder 56 is lowered to the position shown in FIG. 4. The action of the guide pin 58, with respect to the spiral groove 57, provides for orbital rotation of the follower wheel 60 in the direction of the arrow shown in FIG. 5 where it then engages the cam surface 45 of the cam 40. The right hand flanged wheels, in FIG. 3 are now maintained and supported on the main line straight track 29 and as they enter the switching junction the left hand flanged wheels 16 are moving on top of the specially flat straight track rail 30 with the flanges 18 riding upon the flat treadways or tread layers 35. Thus the vehicle 10 is steered through the switching junction on the main track line.

Assuming now that the passenger vehicle 10 is to be switched or steered through the switching junction onto the switch track portion 28, the right hand cylinder 50 in FIG. 3 remains in a non-actuating position with the follower wheel raised. The selector mechanism is now actuated to provide for lowering of the left hand cam cylinder 56 to its lowered position whereby the cam follower 60 is moved in the orbital path shown in FIG. 5 and downwardly into engagement with the curved cam surface 44. This causes the vehicle to be steered onto the switching portion 28 wherein as shown in FIG. 3 the left hand wheels 16 ride on the conventional curved track rail 33 and the right hand wheels 16 are supported and the flanges 18 ride on the special flat track rail 32 which is curved and parallel to the rail 33 so that the vehicle is now moving through the switching junction and continues on the switching portion of the arrangement. The guide rails 38 and 39, of course in both instances during steering, assist in maintaining the vehicle along the direction of steering which has been selected. Thus, it is believed that an improved track arrangement and steering guide means therefor has been disclosed.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. A switching apparatus adapted for use with an associated railway transportation vehicle comprising:

vehicle supporting track means for providing guided movement of said vehicle including a main line track portion having a switching junction and a switch track portion merged with said main line track portion at said switching junction, said main line track portion including a first continuous straight flanged track rail portion extending through said switching junction, and a pair of spaced second straight flanged track rail portions each second straight flanged track portion disposed on a respective first and second end of said switching junction in spaced, generally parallel relation to said first straight flanged track rail portion, and a continuous straight flat track rail coextensive with and adjacent to portions of each of said second flanged track rail portions, and extending therebetween and through said switching junction spaced from and generally parallel to said first straight flanged track rail portion, said switch track portion including first and second curved flanged track portions, said first curved flanged track portion being merged with said second straight flanged track portion disposed at the first end of said switching junction and extending therefrom away from said main line track portion, said second curved flanged track portion being disposed at the second end of said switching junction and extending therefrom away from said main line portion spaced from and in generally parallel relation to said first curved flanged track portion, and a continuous curved flat track rail coextensive with and adjacent to portions of each of said first straight flanged track rail portion and said second curved flanged track rail portion, respectively, and extending therebetween through said switching junction spaced from and generally parallel to said first curved flanged track rail portion, said curved flat track rail intersecting said straight flat track rail intermediate the spaced second straight flanged track rail portions, said vehicle supporting track means being adapted to engage an associated wheel and axle assembly on said vehicle including a pair of laterally spaced flanged wheels including generally flat rims and radially raised flanges, the top of said flat track rails being disposed below the top of said flanged track rail portions such that said flanged track rail portions are adapted to engage and support said associated wheel rims and said flat track rails are adapted to engage and support said associated raised flanges, said flat track rail portions being of greater width than said associated raised flanges, said vehicle supporting track means adapted to provide engagement of one of said flanged track rail portions with the rim of one of said wheels of said associated wheel and axle assembly and engagement of one of said flat track rails with the raised flange of the other wheel of the associated wheel and axle assembly as the vehicle moves through said switching junction on one of said main line track portion and said switch track portion, cam means positioned between said flanged track rail portions and extending substantially at said first end of said junction and adapted to engage associated vehicle mounted cam follower means, said cam means including first and second cam surfaces extending above the level of said flanged track rail portions and said flat track rails, said first cam surface extending generally parallel to said first continuous straight flanged track rail portion and said second cam surface extending generally concentrically to said first curved flanged track rail portion, said cam surfaces being adapted to engage said associated cam follower means, first and second guide rails located inwardly of and generally adjacent to said first straight flanged track rail portion and said first curved flanged track rail portion, respectively, and defining a vehicle wheel flange entrapping space with said respective first flanged track rail portions, said first and second guide rails being disposed in generally overlapping relation relative to said first and second cam surfaces, respectively, to accommodate continuous guidance of the associated vehicle through said switching junction, said cam means having each of its cam surfaces adapted to be selectively engaged by said associated cam follower means for selectively guiding said associated vehicle along one of said main line track portion and said switch track portion and said guide rails adapted to thereafter engage one of said wheel flanges of said associated wheel and axle assembly for continuing guidance of said associated vehicle through said switching junction.

2. The invention in accordance with claim 1, said flat rails having a flat tread portion for engagement with said associated wheel flanges.

3. The invention in accordance with claim 2, said associated cam follower means including a pair of vertically movable first and second cam followers positioned on said associated vehicle in horizontally spaced relation adapted to be selectively moved into engagement with said first and second cam surfaces.

4. The invention in accordance with claim 3, each of said associated cam followers being movable in an orbital path into and out of engagement with said cam surfaces.

5. The invention in accordance with claim 4, said associated cam follower means including first and second fluid extensible devices supporting said first and second cam followers for moving the same vertically and in said orbital path.

* * * * *